US008960259B2

(12) United States Patent
Weston

(10) Patent No.: US 8,960,259 B2
(45) Date of Patent: Feb. 24, 2015

(54) VARIABLE SCREENING

(75) Inventor: Mark Weston, Bradenton, FL (US)

(73) Assignee: University of South Florida, Tampa, FL (US)

( * ) Notice: Subject to any disclaimer, the term of this patent is extended or adjusted under 35 U.S.C. 154(b) by 463 days.

(21) Appl. No.: 13/231,271

(22) Filed: Sep. 13, 2011

(65) Prior Publication Data

US 2012/0061029 A1 Mar. 15, 2012

Related U.S. Application Data

(60) Provisional application No. 61/382,531, filed on Sep. 14, 2010.

(51) Int. Cl.

| | |
|---|---|
| ***E06B 9/56*** | (2006.01) |
| ***A47G 5/02*** | (2006.01) |
| ***A47H 23/00*** | (2006.01) |
| ***E04F 10/06*** | (2006.01) |
| ***E06B 9/08*** | (2006.01) |
| ***A47H 7/00*** | (2006.01) |
| ***E06B 9/06*** | (2006.01) |
| ***F24F 13/08*** | (2006.01) |
| *F24F 11/00* | (2006.01) |

(52) U.S. Cl.

CPC ..... *E06B 9/06* (2013.01); *F24F 13/082* (2013.01); *F24F 2011/0038* (2013.01)

USPC ..... 160/290.1; 160/237; 160/23.1; 160/405

(58) Field of Classification Search

USPC ..... 160/127, 237, 405, 6; 428/136

See application file for complete search history.

(56) References Cited

U.S. PATENT DOCUMENTS

| | | | | |
|---|---|---|---|---|
| 3,065,785 | A * | 11/1962 | Taber | 160/81 |
| 4,105,724 | A * | 8/1978 | Talbot | 261/112.1 |
| 4,279,240 | A * | 7/1981 | Artusy | 126/579 |
| 5,967,788 | A * | 10/1999 | Udoh | 434/211 |
| 6,655,441 | B2 * | 12/2003 | Wen et al. | 160/168.1 P |
| 2007/0184238 | A1 | 8/2007 | Hockaday et al. | |
| 2007/0237923 | A1 * | 10/2007 | Dorsy | 428/136 |
| 2008/0163984 | A1 * | 7/2008 | Lambey | 160/2 |
| 2013/0139976 | A1 * | 6/2013 | Carvallo | 160/90 |

OTHER PUBLICATIONS

Lynn, Greg & Academy Group 1993, "Folding in Architecure", Architectural Design, No. 102, Academy Editions, London, pp. 24-31.

http://www.nytimes.com/2008/04/06/magazine/06nouvel.html?pagewanted=all.

http://www.architectmagazine.com/energy-efficiency/visible-green.aspx.

Drozdowski, Z, 2009, "Adaptive Frilling as Case Exploration for Adaptivity in Architecture", Association for Computer Aided Design in Architecture Acadia, Chicago, pp. 105-109.

* cited by examiner

*Primary Examiner* — Katherine Mitchell
*Assistant Examiner* — Jeremy Ramsey
(74) *Attorney, Agent, or Firm* — Thomas | Horstemeyer, LLP

(57) ABSTRACT

In one embodiment, a variable screen includes a generally flat sheet having a front surface, a back surface, and a plurality of elongated slits that extend through the sheet from the front surface to the back surface, wherein the sheet includes a shape memory material that enables the slits to open into openings through which light and fluid can pass when a tensile force is applied to the sheet in a direction generally perpendicular to the slits and further enables the slits and openings to automatically when the tensile force is removed.

13 Claims, 16 Drawing Sheets

VARIABLE SCREENING

CROSS-REFERENCE TO RELATED APPLICATION(S)

This application claims priority to U.S. Provisional Application Ser. No. 61/382,531, filed Sep. 14, 2010, which is hereby incorporated by reference herein in its entirety.

BACKGROUND

Solar shading is an essential component to good passive energy design for buildings. Sun angles and building orientation have been basic architectural considerations dating as far back as ancient Egypt, and are commonly seen in such vernacular building formations as shotgun and dog-trot houses, or wrap-around porches. Traditionally, solar design has come in the form of static shading devices applied to building openings, or in building forms which accommodate such strategies in their basic shape and orientation. New technologies, however, have created adaptive solar shading that responds to lighting conditions, time of day, and the presence of building occupants. Although active shading systems currently exist, they tend to rely on mechanical solutions to architectural problems. The use of material-based solutions remains substantially unexplored.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1:
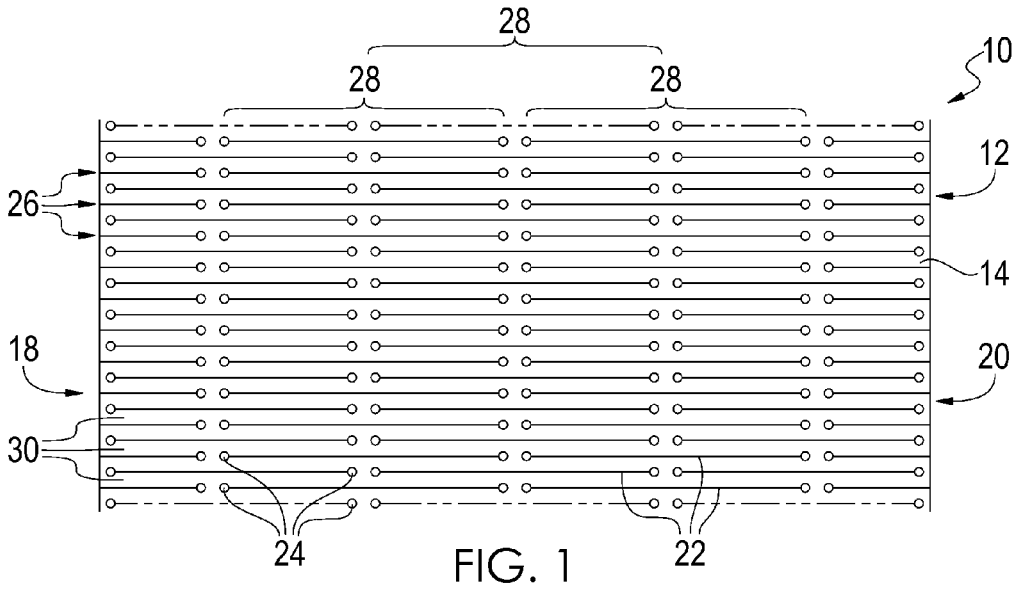
FIG. 1 is a front view of a first embodiment of a variable screen shown in a closed orientation.

As described above, current adaptive shading systems are largely mechanical in nature and typically are not material-based solutions. Disclosed herein is variable screening that can be used to provide adaptive shading, among other benefits. Generally speaking, the disclosed variable screening uses the properties of flexible materials to form a screen that changes shape to create openings that vary in density according to the needs of the operator or application. This technology is useful for any application that requires a controlled and variable screen for the passage of light or fluids, such as air or water.

In one embodiment, slits are formed in a sheet of flat material. When the sheet is pulled along a direction that is generally perpendicular to length of the slits, openings are created that allow the passage of variable amounts of light and/or fluid depending on the tension applied. When the tension is released, however, the sheet automatically returns to its original shape, thereby limiting or preventing the passage of light and/or fluid.

In another embodiment, elongated strips of flexible material are aligned vertically or horizontally. The strips are then twisted along their longitudinal axes to enable the passage of light and/or fluid to variable degrees depending on the degree of twist that is applied. When untwisted, the strips automatically return to their initial flat shape, thereby limiting or preventing the passage of light and/or fluids.

The disclosed technology is useful for any application that requires a controlled and variable screen for the passage of light or fluid. In architectural applications it can be used as solar shading for enclosed or unenclosed buildings, an active photovoltaic device, a privacy screen, a light diffuser, an air diffuser, a wind screen, a protective barrier, or decoration. In some cases, optimal angles and opacities can be created to shade buildings and building openings to provide diffuse light while blocking direct light, or to provide visibility through the screen from selective angles. Such functionality is enabled by the use of flexible shape memory materials that can change shape when a force is applied to them but return to an original shape when the force is removed. The variable screens therefore can be stretched, bent, and twisted as needed to provide the desired result.

In the following disclosure, various embodiments are described. It is to be understood that those embodiments are example implementations of the disclosed inventions and that alternative embodiments are possible. All such embodiments are intended to fall within the scope of this disclosure.

FIGS. 1-4 illustrate a first embodiment of a variable screen 10. As is shown in those figures, the screen 10 comprises a generally flat sheet 12 of material that is defined at least in part by a first or front surface 14, a second or back surface 16, and opposed lateral edges 18 and 20. Not shown in FIGS. 1-4 are opposed top and bottom ends of the sheet 12. The material used to construct the flat sheet 12 is a shape memory material that can be deformed in one or more directions in response to an applied force, and return to its original shape when the force is removed. Such materials can include wood, metal, and polymer materials. In addition, the materials can be composite materials, such as carbon fiber or fiberglass. In some embodiments, the material can be a laminate material that comprises multiple layers of material, which can be the same material or different types of material. The dimensions of the sheet 12, such as thickness, height, and width, can vary greatly depending upon the intended application. As is described below, the screen 10 can be used in small applications, such as use as a window shade, or large applications, such as use as a building shade or barrier. Therefore, the dimensions can range from microns to meters. This can be said for every screen embodiment described herein.

With particular reference to FIG. 1, which shows the variable screen 10 in its natural, closed orientation, the sheet 12 comprises multiple elongated linear slits 22 that extend through the sheet from its front surface 14 to its back surface 16. In the embodiment of FIGS. 1-4, the slits 22 are each generally parallel to each other and extend across the screen 10 in a lateral direction that is generally perpendicular with the lateral edges 18, 20 of the sheet 12. The slits 22 can be formed using any suitable cutting technique, including laser cutting. As is further shown in FIG. 1, each slit 22 can terminate in a circular opening 24 that acts as a stress relief that prevents unintended progression of the slits.

In the embodiment of FIGS. 1-4, the slits 22 can be said to be arranged in both lateral rows 26 and vertical columns 28 (in the orientation of FIG. 1) that are orthogonal to each other. Each slit 22 can be said to lie in a row 26 that extends across the sheet 12 in a lateral direction that is generally perpendicular with the lateral edges 18, 20 of the sheet, with each slit being separated from the next slit in the row by a small distance (relative to the length of the slits). Each slit 22 can also be said align with other slits within a column 28 that is generally parallel to the lateral edges 18, 20 of the sheet with each slit of the column being separated from the next slit in the column by a relatively small distance (relative to the length of the slits). As is shown in FIG. 1, portions of other slits contained within other columns 28 can sit between slits within a given column. The columns 28 of slits 22 therefore partially overlap each other across the width direction of the sheet 12 (in the orientation of FIG. 1) to form a staggered configuration apparent from the figure.

As can further be appreciated from FIG. 1, the formation of the slits 22 results in the creation of multiple slats 30 that are likewise arranged in both orthogonal rows and columns across the sheet 12. As is described below, those slats 30 can block light or fluids even when the variable screen 10 is in an open orientation.

Figure 2:
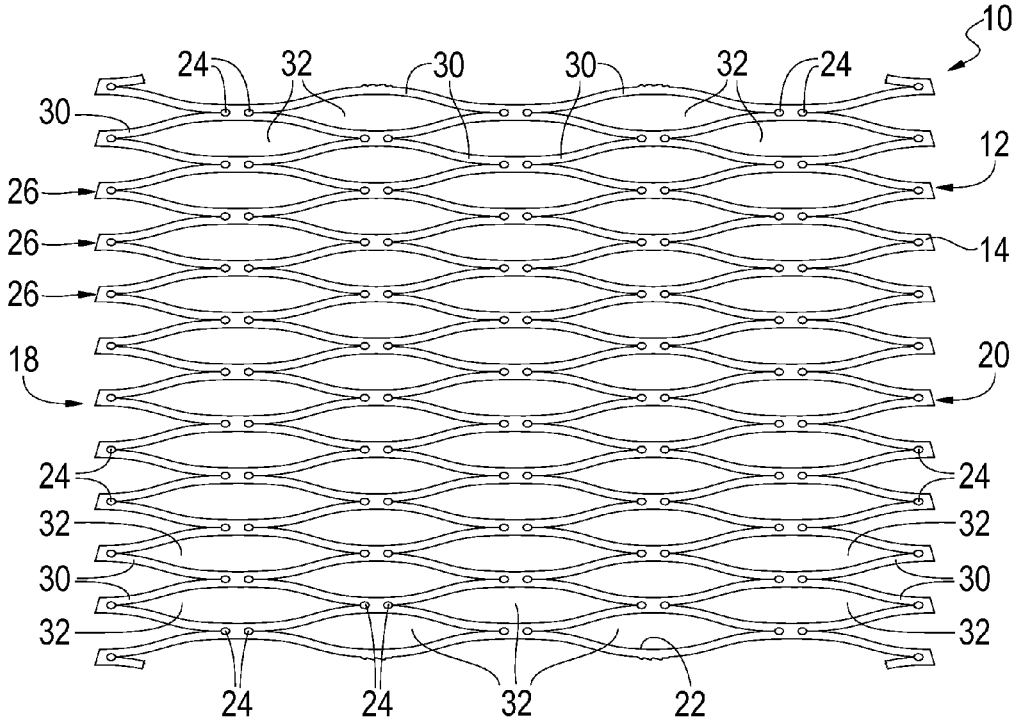
FIG. 2 is a front view of the variable screen of FIG. 1 shown in an open orientation.

Because the variable screen 10 is made of a shape memory material, it can be deformed and automatically return to its original shape. FIG. 2 shows the screen 10 in an open orientation that results when the sheet 12 is stretched along the vertical direction (in the orientation of FIG. 2) by a tensile force. The tensile force causes the slats 30 of the sheet 12 to deform and separate such that the slits 22 open to form openings 32 that are likewise arranged in both orthogonal rows and columns. The shape of the openings 32 depends upon the amount of tensile force that is applied to the sheet 12 and the degree to which the slats 30 are deformed. In some cases, however, the openings 32 assume a general "eye" shape characterized by a relatively large lateral width, a relatively small vertical height, a rounded center, and pointed lateral ends (in the orientation of FIG. 2).

Figure 3:
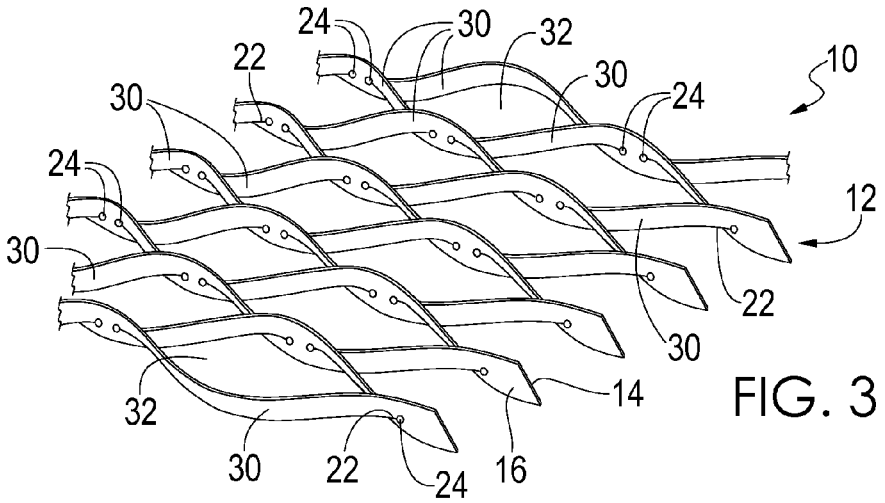
FIG. 3 is a perspective view of the variable screen of FIG. 1 shown in an open orientation.

As is shown in FIG. 3, the slats 30 do not only deform vertically. Instead, the slats 30 further rotate or twist about their longitudinal axes such that the largely two-dimensional sheet 12 adopts a more three-dimensional shape having an increased thickness dimension. As is described below, this twisting can provide for increased insolation and, if the sheet 12 is provided with photovoltaic devices, solar power generation. Once the tensile force is removed, the sheet 12 automatically returns to its original closed orientation without the application of any other force to the sheet.

Figure 4:
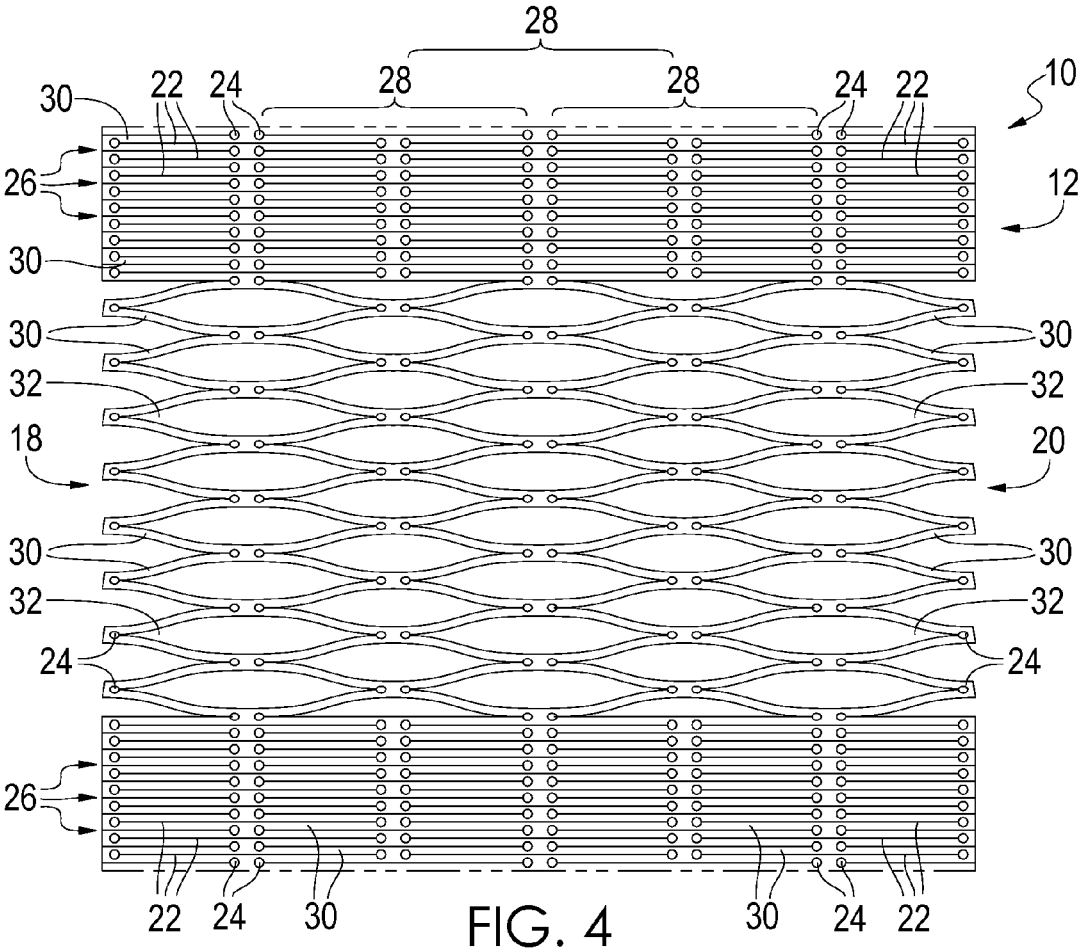
FIG. 4 is a front view of the variable screen of FIG. 1 shown in a partially open orientation.

Although the variable screen 10 can be opened uniformly across its vertical length, it can, in some cases, be selectively opened, or not opened, along its length. FIG. 4 illustrates an example of this. In the case shown in FIG. 4, the screen 10 is open in a central region, but closed along top and bottom portions of the screen. Such operation can be achieved using various mechanical means, an example of which being described below in relation to FIGS. 15A-15D.

Figure 5:
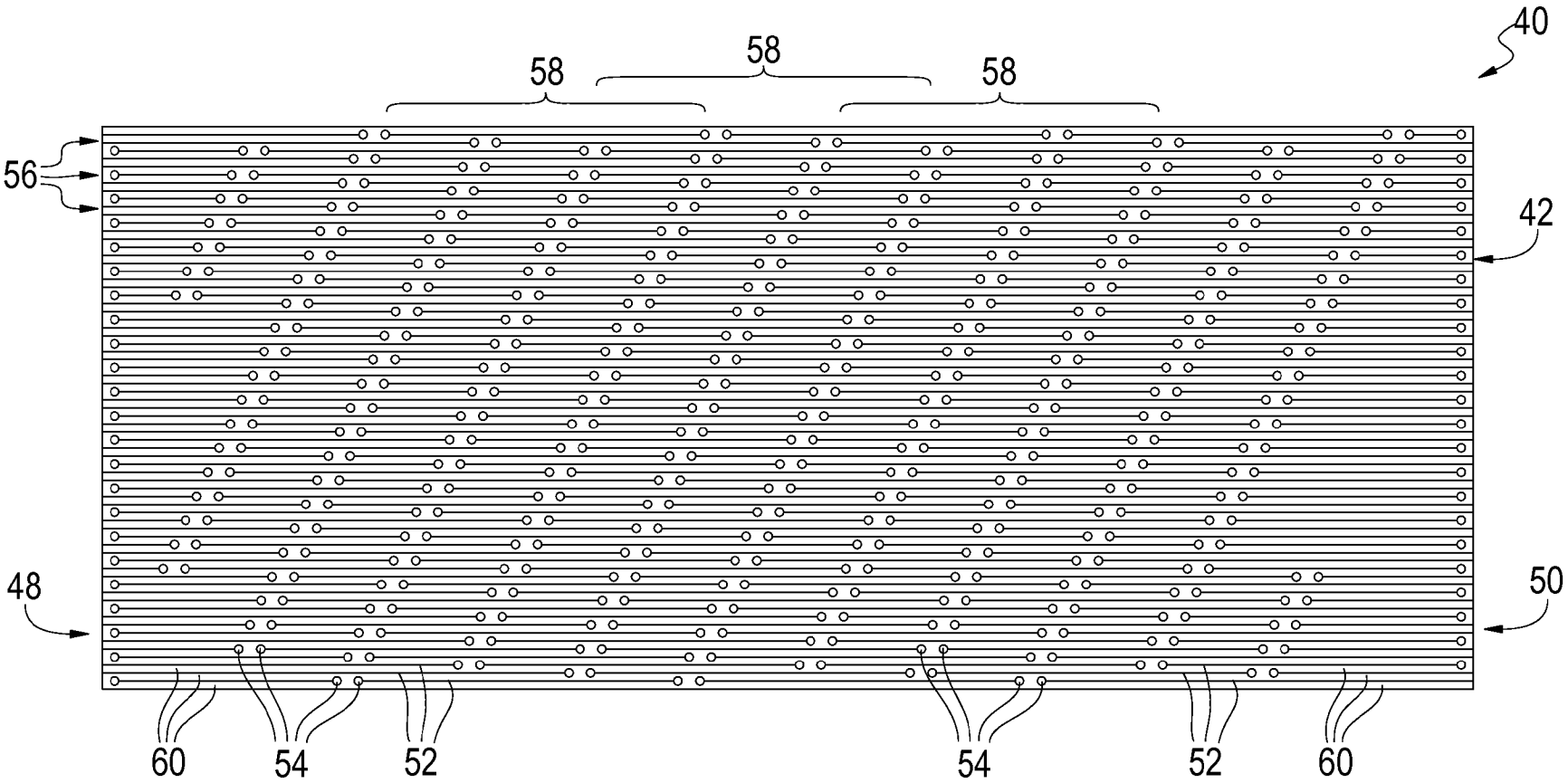
FIG. 5 is a front view of a second embodiment of a variable screen shown in a closed orientation.
Figure 6:
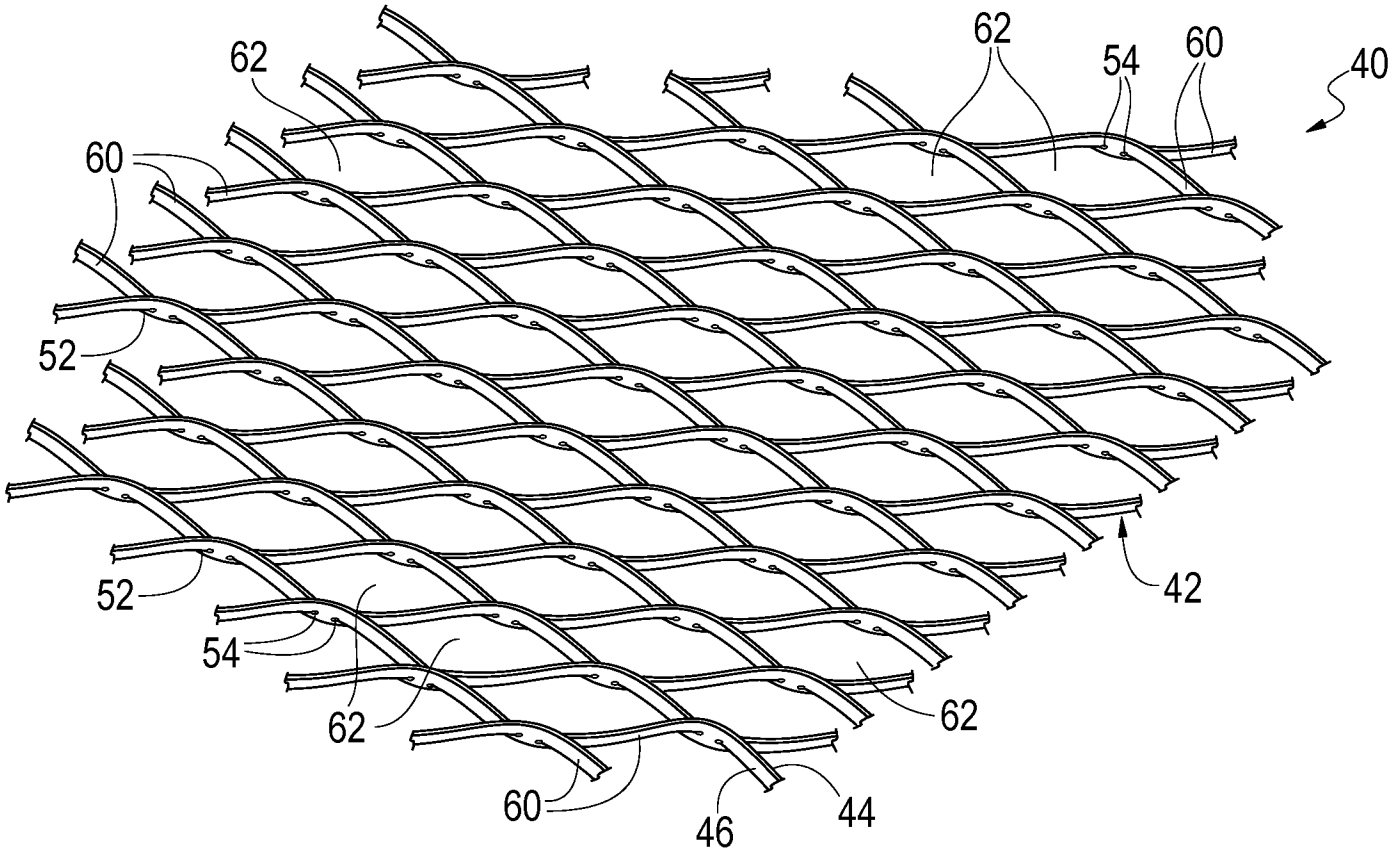
FIG. 6 is a perspective view of the variable screen of FIG. 5 shown in an open orientation.

FIGS. 5 and 6 illustrate a second embodiment of a variable screen 40, which is a variation on the variable screen 10 shown in FIGS. 1-4. As is shown in FIGS. 5 and 6, the screen 40 also comprises a generally flat sheet 42 of material that is defined by a first or front surface 44, a second or back surface 46, and opposed lateral edges 48 and 50. The material used to construct the flat sheet 42 can be a shape memory material similar to that used to construct the variable screen 10.

With particular reference to FIG. 5, which shows the variable screen 40 in its natural, closed orientation, the sheet 42 comprises multiple linear slits 52 that extend through the sheet from its front surface 44 to its back surface 46, and that terminate in circular openings 54. As in the embodiment of FIGS. 1-4, the slits 52 can be said to be arranged both in lateral rows 56 and vertical columns 58 (in the orientation of FIG. 5). However, in the embodiment of FIGS. 5 and 6, the columns 58 are not generally parallel to the lateral edges 48, 50 of the sheet 42. Instead, the columns 58 extend diagonally across the sheet 42 so as to form an acute angle with the lateral edges 48, 50. Although one particular diagonal configuration is shown in FIG. 5, many others are possible. Therefore, a greater or smaller angle can be formed between the columns 58 of slits 52 and the lateral edges 48, 50.

As with the embodiment of FIGS. 1-4, the formation of the slits 52 results in the creation of multiple slats 60 that are likewise arranged in both rows and columns across the sheet 42. Because the variable screen 40 is made of a shape memory material, it can be deformed and return to its original shape. FIG. 6 illustrates the screen 40 in an open orientation that results when the sheet 42 is stretched along the vertical direction (in the orientation of FIG. 6) by a tensile force. The tensile force causes the slats 60 of the sheet 42 to deform and separate such that the slits 52 open to form openings 62 that are likewise arranged in both rows and columns, in this case lateral rows and diagonal columns. The shape of the openings 62 depends upon the amount of tensile force that is applied to the sheet 42 and the degree to which the slats 60 are deformed. Again, the openings 62 can assume a general "eye" shape characterized by a relatively large lateral width, a relatively small vertical height, a rounded center, and pointed lateral ends. As is shown in FIG. 6, the slats 60 do not only deform vertically. Instead, the slats 60 further twist or rotate about their longitudinal axes such that the largely two-dimensional sheet 42 adopts a more three-dimensional shape having an increased thickness dimension.

Figure 7:
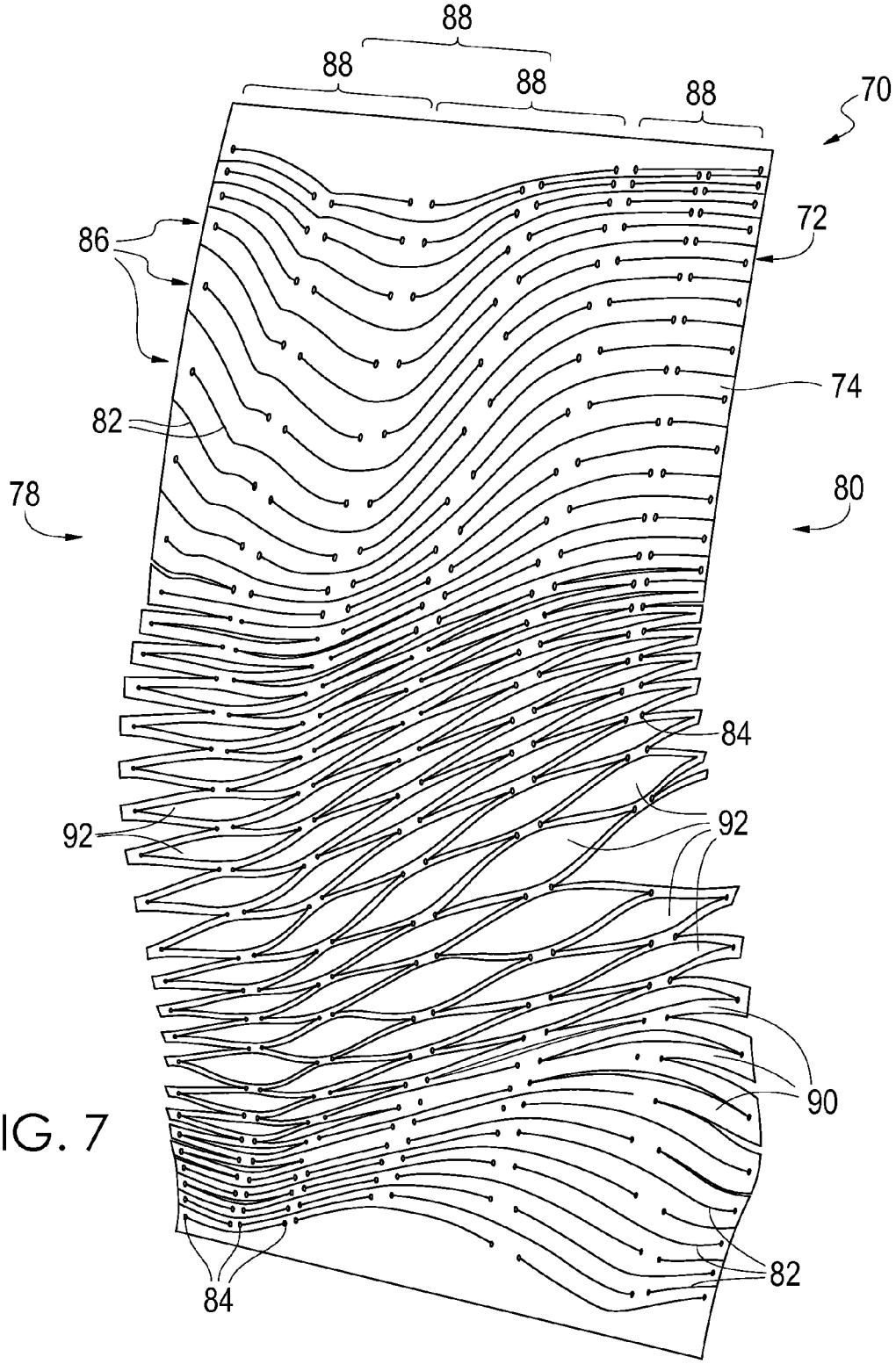
FIG. 7 is a front view of a third embodiment of a variable screen shown in a partially open orientation.

FIG. 7 illustrates a third embodiment of a variable screen 70, which is also a variation on the variable screen 10 shown in FIGS. 1-4. The screen 70 also comprises a generally flat sheet 72 of material that is defined by a first or front surface 74, a second or back surface (not visible), and opposed lateral edges 78 and 80. The material used to construct the flat sheet 72 can be a shape memory material similar to that used to construct the variable screen 10.

The variable screen 70 includes multiple slits 82 that extend through the sheet from its front surface 74 to its back surface, and that terminate in circular openings 84. In the embodiment of FIG. 7, however, the slits 82 are curved instead of being linear. Despite this, the slits 82 can be arranged both in lateral rows 86 and vertical columns 88.

As with the embodiment of FIGS. 1-4, the formation of the slits 82 results in the creation of multiple slats 90 that are likewise arranged in both rows and columns across the sheet 72. In this case, the slats 90 can have different height dimensions and can be of varying height. Because the variable screen 70 is made of a shape memory material, it can be deformed and return to its original shape. FIG. 7 shows the screen 70 in a partially open orientation in which a center portion of the screen has been stretched along the vertical direction (in the orientation of FIG. 7) by a tensile force. The tensile force causes the slats 90 of the sheet 72 to deform and separate such that the slits 82 open to form openings 92 that are likewise arranged in both rows and columns. The shape of the openings 92 depends upon the amount of tensile force that is applied to the sheet 72 as well as the shape of the slits 82. As with the other embodiments, the slats 90 twist about their longitudinal axes such that the largely two-dimensional sheet 72 adopts a more three-dimensional shape having an increased thickness dimension.

Figure 8:
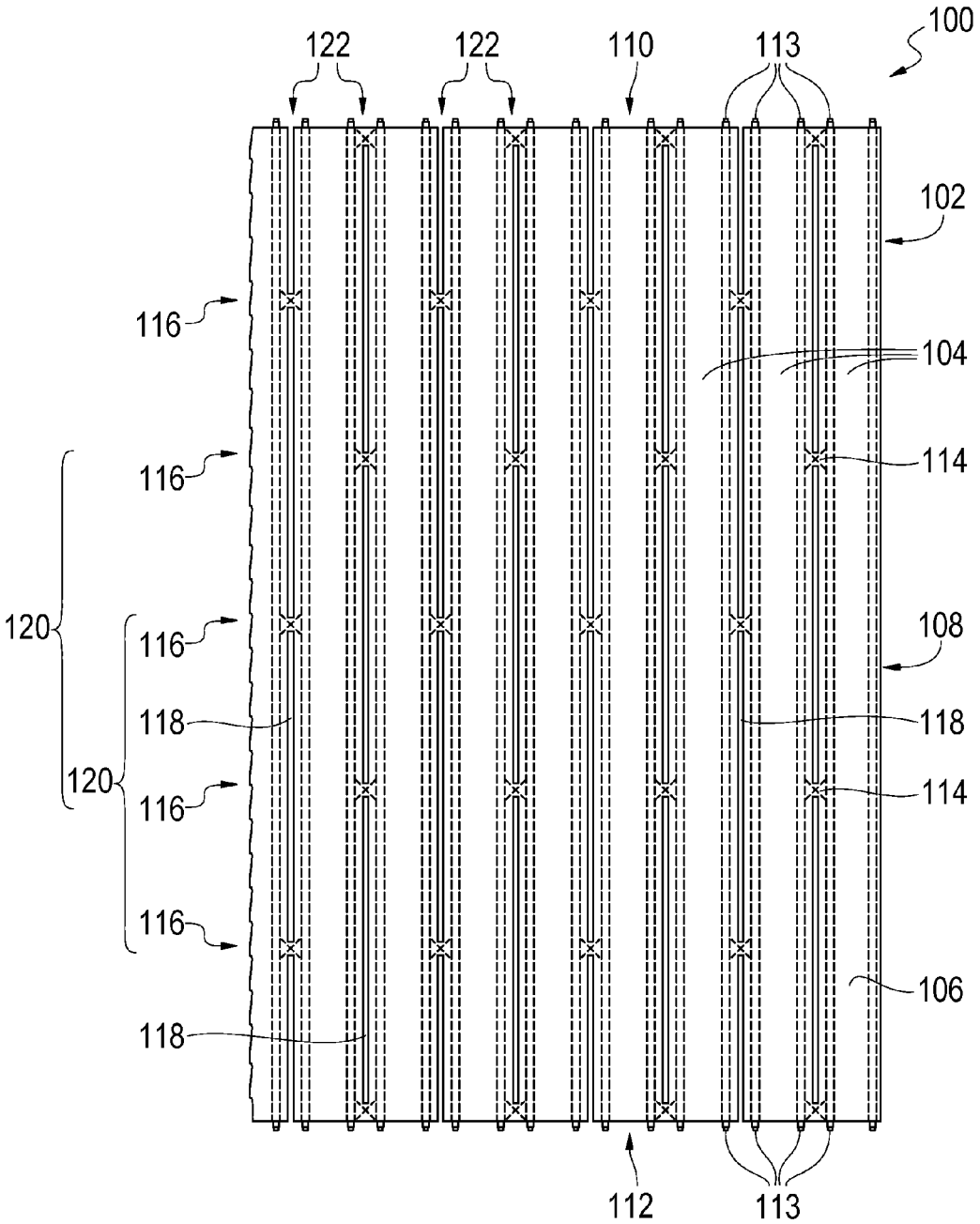
FIG. 8 is a front view of a fourth embodiment of a variable screen shown in a closed orientation.
Figure 9:
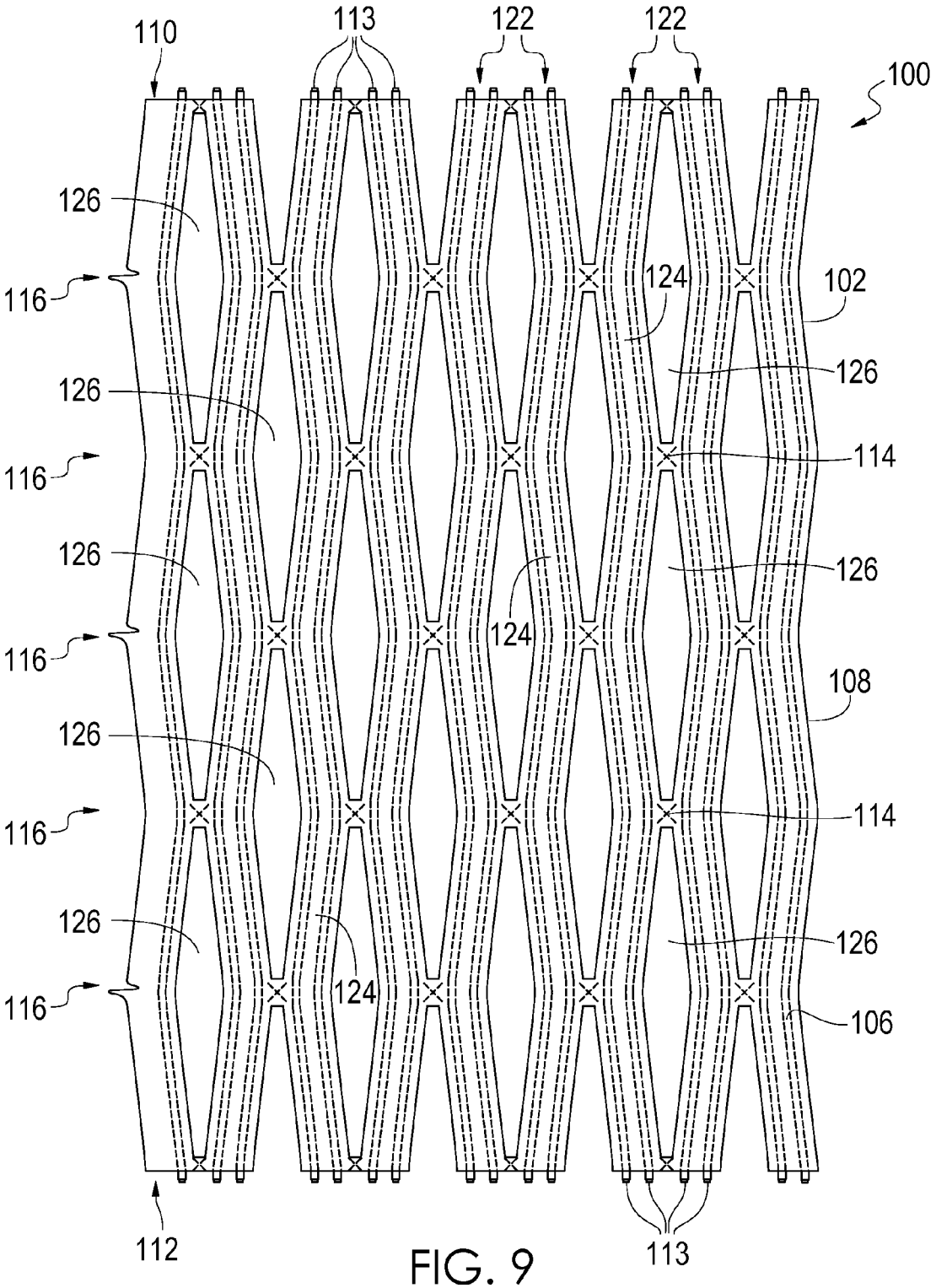
FIG. 9 is a front view of the variable screen of FIG. 8 shown in an open orientation.

FIGS. 8 and 9 illustrate a fourth embodiment of a variable screen 100, with FIG. 8 showing the natural, closed orientation, and FIG. 9 showing an open orientation. The variable screen 100 comprises a generally flat sheet 102 that includes multiple elongated strips 104 of material that are aligned so as to be parallel to each other along a vertical height direction of the screen (in the orientation of FIGS. 8 and 9). Unlike the previous embodiments, which employed shape memory material to construct the sheet, the strips 104 that form the sheet 102 are made of a flexible textile having no shape memory. The textile can comprise a woven (or otherwise arranged) fabric including synthetic and/or natural fibers. By way of example, the textile comprises a rip-stop nylon fabric. In some embodiments, the textile can include reinforcing fibers made of an aramid material, such as para-aramid (Kevlar®). Although the sheet 102 is composed of strips 104, the sheet is still defined at least in part by a first or front surface 106, a second or back surface (not visible), opposed lateral edges including edge 108, a first or top edge 110, and a second or bottom edge 112. Like the other variable screens, the dimensions of the sheet 102, such as height and width, can vary greatly depending upon the intended application.

Extending along opposed edges of each strip 104 along the longitudinal direction of the strips are elongated shape memory elements 113 that provide shape memory characteristics to the strips. In some embodiments, the shape memory elements 113 comprise rods or battens made from a material that can be deformed but return to its original shape. Example materials include wood, metal, and polymer materials. In addition, the materials can be composite materials, such as carbon fiber or fiberglass. In some embodiments the shape memory elements 113 are each provided in an elongated pocket that is formed (e.g., sewn) along the lateral edges of each strip 104.

The strips 104 are connected together connection points 114. In some embodiments, the connection points 114 comprise connection elements in the form of additional pieces of textile material, for example the same textile material used to form the strips 104, that are sewn to the edges of the strips in predetermined locations. As is shown in FIGS. 8 and 9, the connection points 114 can be arranged in staggered rows 116 that extend laterally across the width of the sheet 102. The provision of the connection points 114 results in the formation of elongated linear slits 118 that extend along the vertical direction of the sheet 102 (in the orientation of FIG. 8) generally parallel with the lateral edges of the sheet. Because the locations of the connection points 114 are staggered, the slits 118 are likewise staggered. More specifically, the slits 118 can be said to be arranged in both lateral rows 120 and vertical columns 122 (in the orientation of FIG. 1), with the rows of slits 118 overlapping each other across the sheet 102 to form the staggered configuration apparent from in the figure. The formation of the slits 118 results in the creation of multiple slats 124 that are likewise arranged in both orthogonal rows and columns across the sheet 102 (see FIG. 9).

Because the variable screen 100 includes the shape memory elements 113, the screen can be deformed and automatically return to its original shape. FIG. 9 shows the screen 100 in an open orientation that results when the sheet 102 is stretched along the lateral direction (in the orientation of FIG. 9) by a tensile force. The tensile force causes the slats 124 of the sheet 102 to deform and separate such that the slits 118 open to form openings 126 that are likewise arranged in both orthogonal rows and columns. The shape of the openings 126 depends upon the amount of tensile force that is applied to the sheet 102 and the degree to which the slats 124 are deformed. In some cases, however, the openings 126 assume a general "diamond" shape characterized by a relatively large vertical height, a relatively small lateral width, and pointed top and bottom ends (in the orientation of FIG. 9). As with the other embodiments, once the tensile force is removed, the sheet 102 automatically returns to its original closed orientation without the application of any other force to the sheet.

Figure 10:
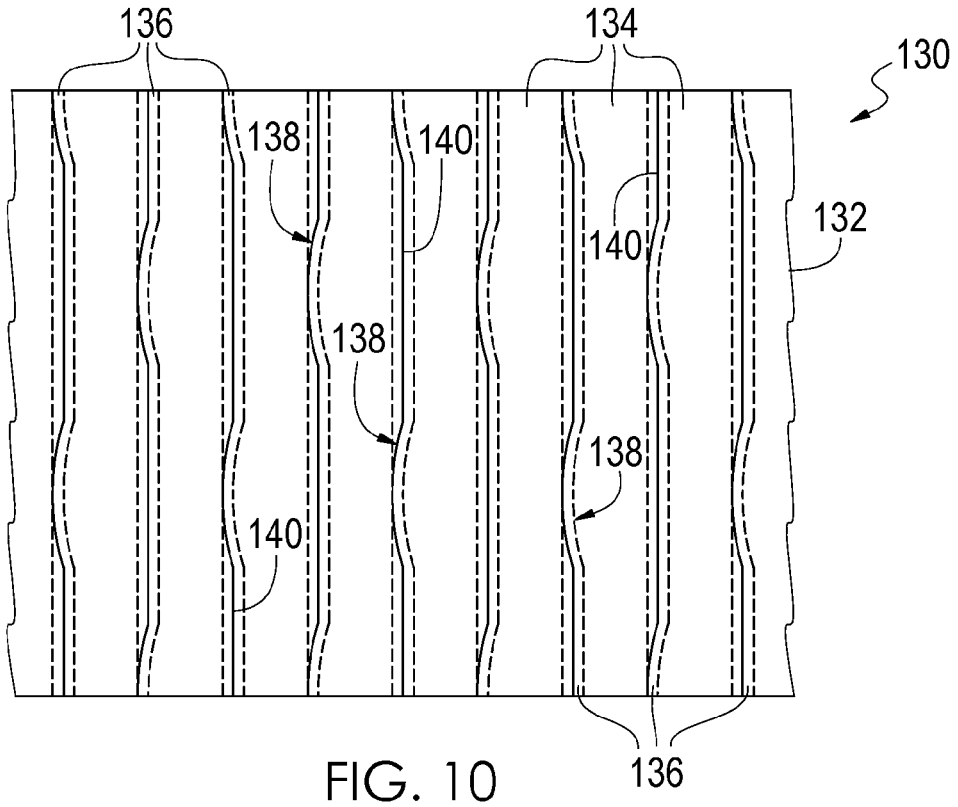
FIG. 10 is a front view of a fifth embodiment of a variable screen shown in a closed orientation.
Figure 11:
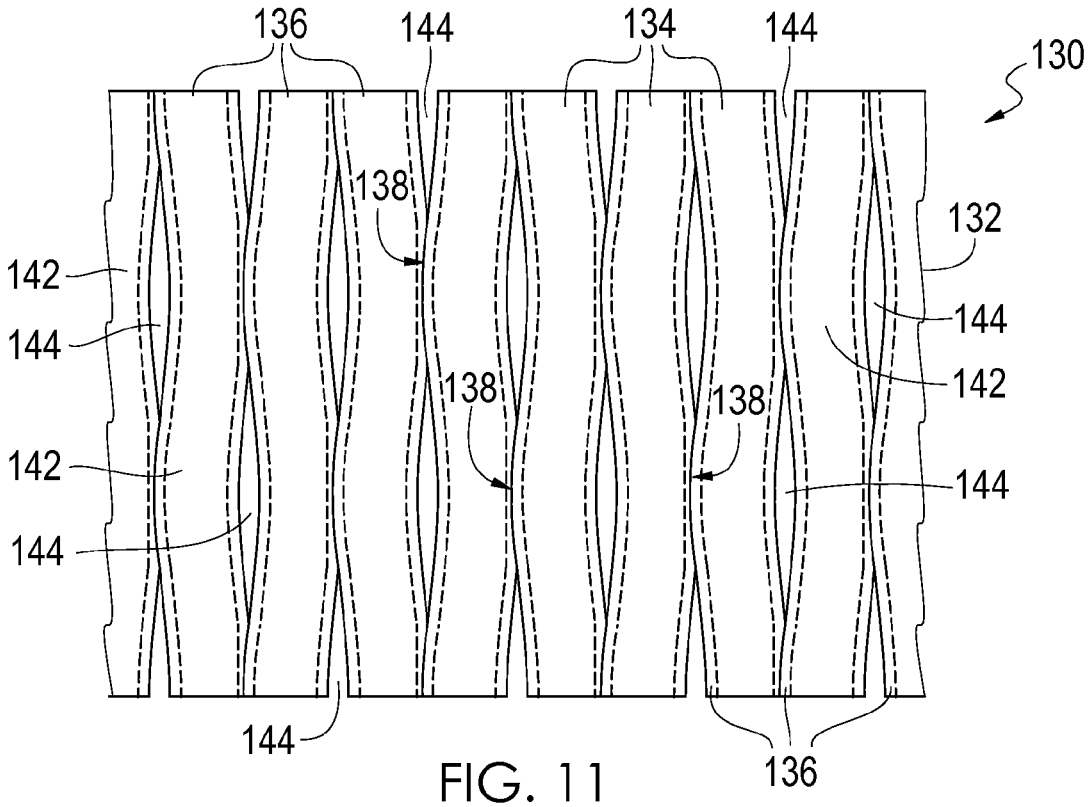
FIG. 11 is a front view of the variable screen of FIG. 10 shown in an open orientation.

FIGS. 10 and 11 illustrate a fifth embodiment of a variable screen 130 that is similar in several respects to the fourth embodiment of FIGS. 8 and 9. Therefore, the variable screen 130 comprises a generally flat sheet 132 comprised by multiple elongated strips 134 of flexible textile material that are aligned so as to be parallel to each other along the vertical direction (in the orientation of FIGS. 10 and 11). Provided along the edges of each strip 134 is a shape memory element 136 that provides shape memory characteristics to the strips. In the embodiment of FIGS. 10 and 11, however, the strips 134 are connected together at various connection points 138. In some embodiments, the strips 134 are sewn or glued together at the connection points 138. As with the embodiment of FIGS. 8 and 9, the connection points 138 form staggered elongated linear slits 140 that extend along the vertical direction of the sheet (in the orientation of FIGS. 10 and 11) generally parallel with the lateral edges of the sheet 102. The formation of the slits 140 results in the creation of multiple slats 142 that are likewise arranged in both orthogonal rows and columns across the sheet 102 (see FIG. 11).

Because the variable screen 130 includes the shape memory elements 136, the screen can be deformed and return to its original shape. FIG. 11 shows the screen 130 in an open orientation that results when the sheet 132 is stretched along the lateral direction (in the orientation of FIG. 11) by a tensile force. The tensile force causes the slats 142 of the sheet 132 to deform and separate such that the slits 140 open to form openings 144 that are likewise arranged in both orthogonal rows and columns.

Figure 12:
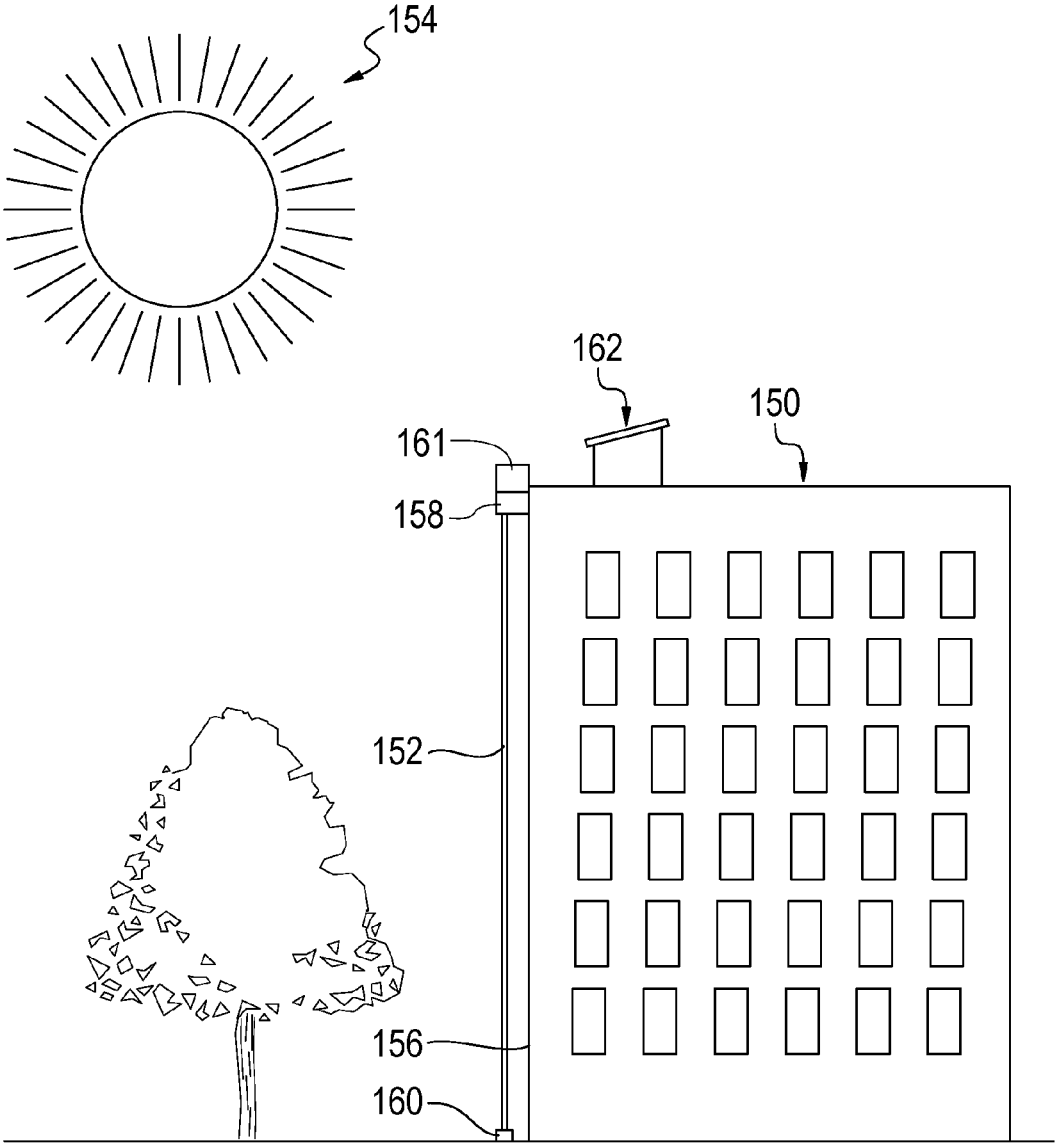
FIG. 12 is a side view of a building equipped with a variable screen that provides shade to the building.

FIG. 12 illustrates an example large-scale application for a variable screen of the type described above. In FIG. 12, a building 150 is shaded by a variable screen 152 that is positioned between the sun 154 and a front side 156 of the building. The screen 152 is suspended by a housing 158 and is secured to a base member 160 that is provided on the ground. Associated with the housing 158 is a motor 161 that can be used to roll up at least a portion of the screen 152 within the housing 158. Because the screen 152 is secured to the base member 160, rolling up the screen within the housing 158 applies tension to the screen and causes it to open in the manner described above in relation to FIGS. 1-11.

In some embodiments, the screen 152 can be automatically opened or closed depending upon environmental conditions. For example, the angle or intensity of the sun can be detected with a light sensor 162 and the orientation of the screen 152 can be automatically controlled in response to the detected angle or intensity by automatically controlling the motor 161. In other embodiments, the screen 152 can be controlled relative to the global coordinates of the building 150, the day of the year, and/or the time of day. In still further embodiments, operation of the motor 161 can be computer programmed relative to user preferences. If the screen 152 were intended for shielding the building 150 from wind instead of light, the orientation of the screen could instead be controlled in relation to sensed wind speed.

As can be appreciated from the embodiment of FIG. 12, variable screens can be provided in architectural applications that change shape in response to ambient conditions and user/or wishes based on extremely simple mechanical actuation. Such screens can contribute to the creation of a materially-rich architectural environment, while still accommodating building performance and occupant needs. Optimal angles and opacities can be achieved to shade buildings and building openings to provide the passage of diffuse light while blocking direct light, or to allow visibility through the screen from selective angles. When fully closed, the screen can be made sufficiently strong to resist the damaging effects of hurricanes and major wind storms, to block sunlight, or to provide privacy. When fully open, the screen can allow the passage of natural light and breezes, and to provide views to the outdoors.

Figure 13:
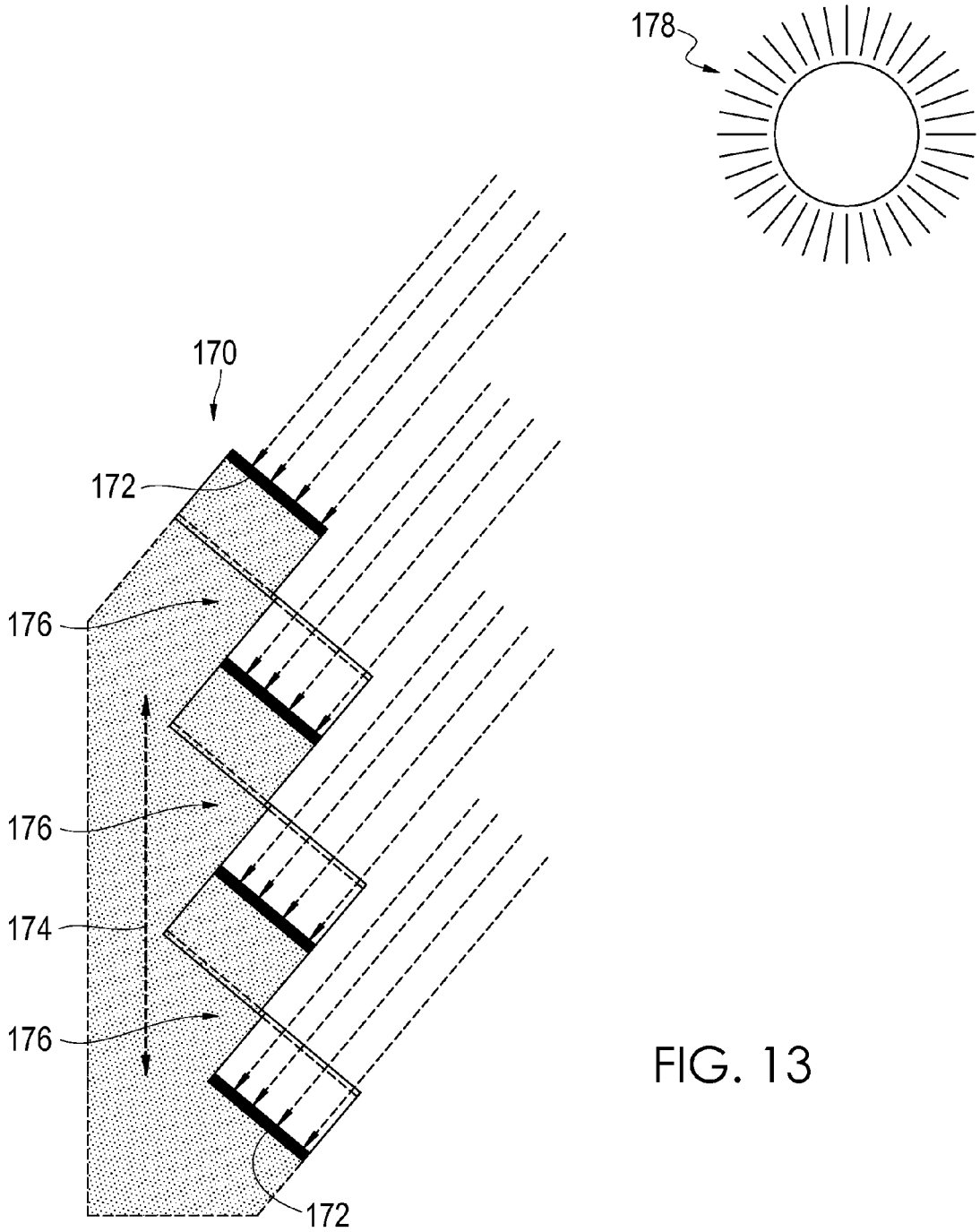
FIG. 13 is a cross-sectional view of a variable screen illustrating solar shading provided by the screen.

FIG. 13 illustrates the type of shading that a variable screen 170, similar to the screens shown in FIGS. 1-6, can provide. As is shown in FIG. 13, the slats 172 of the screen 170 have been deformed because of the application of a tensile force along the directions identified by arrow 174. Although the application of the force causes openings 176 to form within the screen 170, the slats 172 are angled so as to be generally perpendicular to incident light rays (identified by multiple dashed arrows) emitted by the sun 178. Therefore, the screen 170 provides shade (identified by the shaded region) but simultaneously enables diffuse light and air to pass through the screen. The screen 170 therefore can be deformed not only to occlude or permit the passage of light and/or fluid, but also to produce optimal angles for the maximizing the interception of solar radiation of the surface of the screen.

Figure 14:
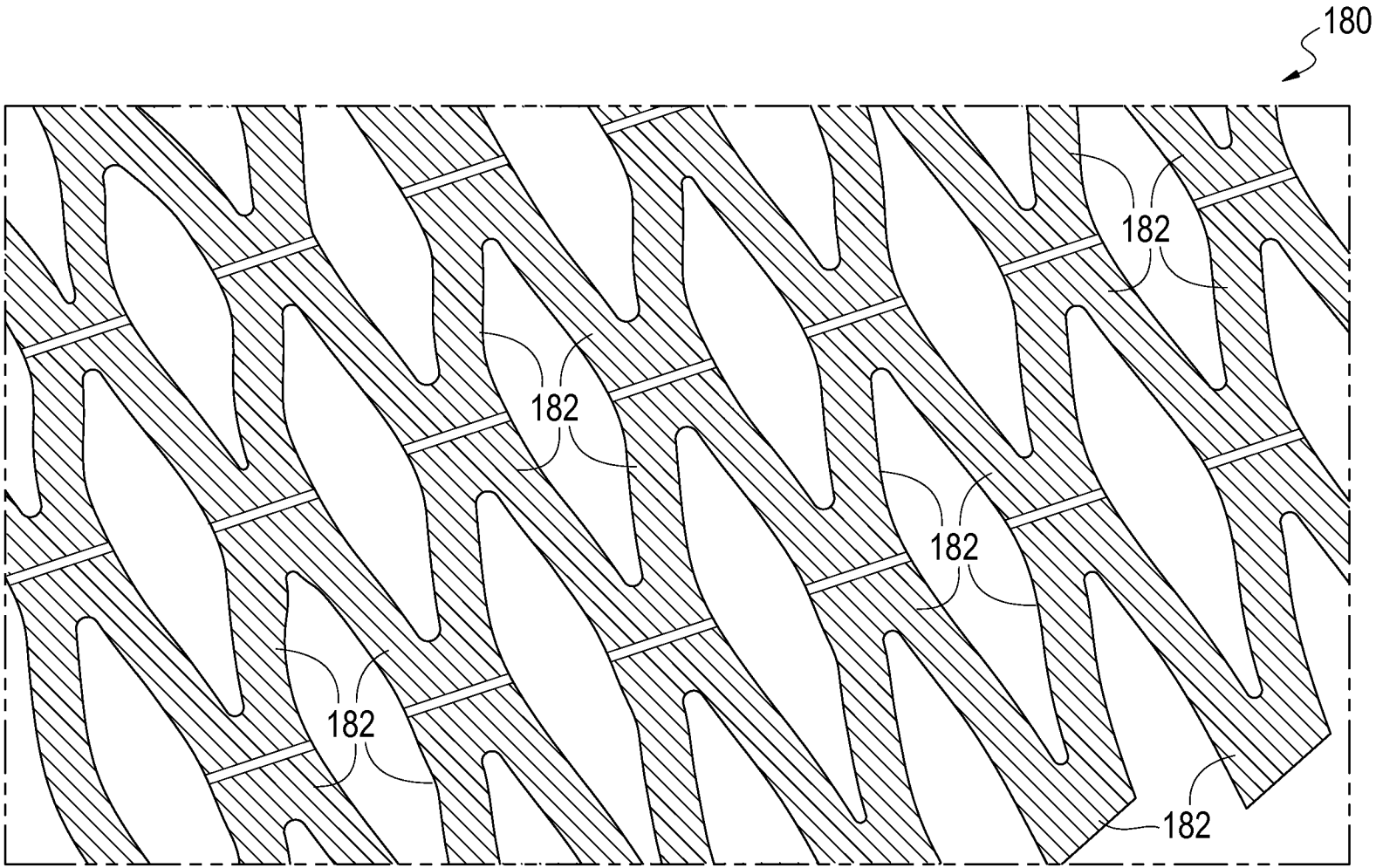
FIG. 14 is a front view of a sixth embodiment of a variable screen shown in an open orientation.

In cases such as those described in relation to FIGS. 12 and 13 in which a screen is to receive a large amount of incident sunlight, the screen can be provided with photovoltaic elements to capture the light and convert it into electricity. FIG. 14 illustrates such an embodiment. In that figure, a variable screen 180 (shown in an open configuration) is provided with multiple photovoltaic cells 182 that are adapted to use light energy in the form of photons from the sun to generate electricity through the photovoltaic effect.

Figure 15A:
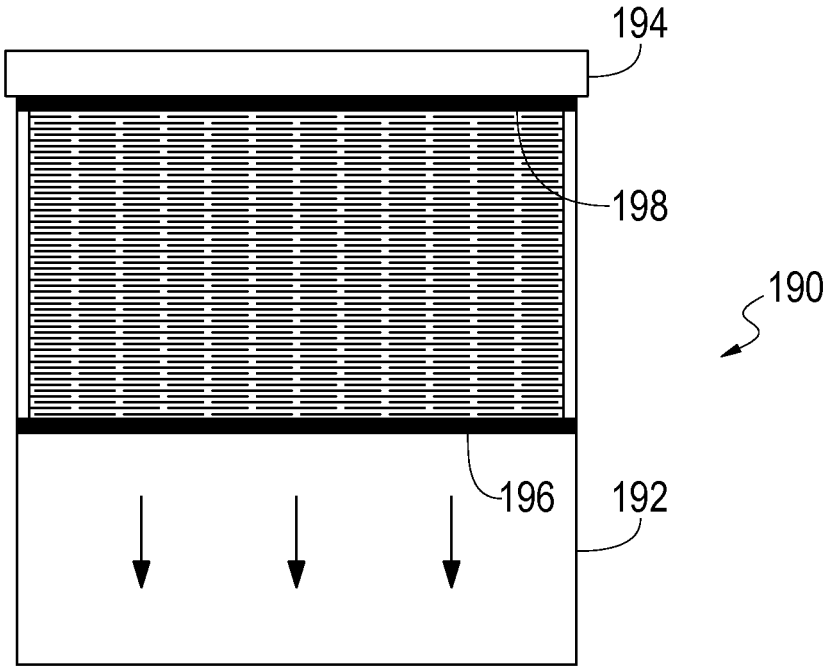
FIG. 15A-15D are views of a variable screen associated with a window, the screen being manipulated to provide solar shading.
Figure 15B:
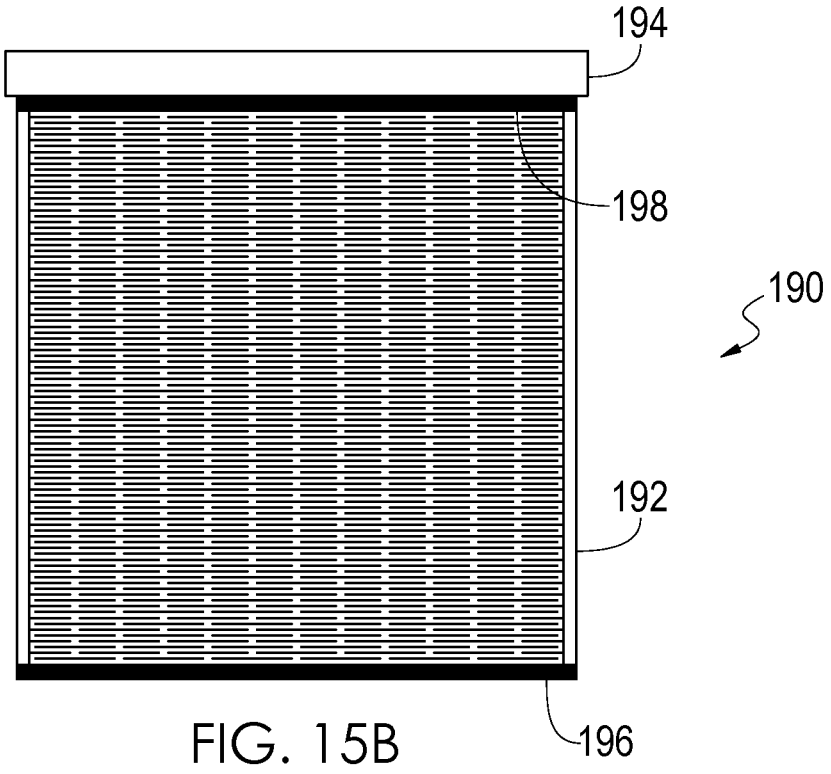

FIGS. 15A-15D illustrate an example small-scale application for a variable screen. In particular, those figures show a screen 190 that is used in a window 192 of a home, office, or other structure. The screen 190 can be rolled up within a housing 194 provided at the top of the window 192. As with the embodiment of FIG. 12, a motor (not shown) can assist the user in rolling up the screen 190. When the screen 190 is to be used, for example to block light or provide privacy, the screen can be extended downward, as depicted in FIG. 15A, so that the entire window 192 is ultimately covered by the screen, as depicted in FIG. 15B. In some embodiments, the screen 190 can be extended downward using the motor within the housing 194 as well as a first track member 196 secured to the end of the screen that is driven downward along opposed tracks (not shown) along the sides of the window 192 by the motor. When the screen 190 has been fully extended as shown in FIG. 15B, substantially all light is blocked and maximum shading is provided.

Figure 15C:
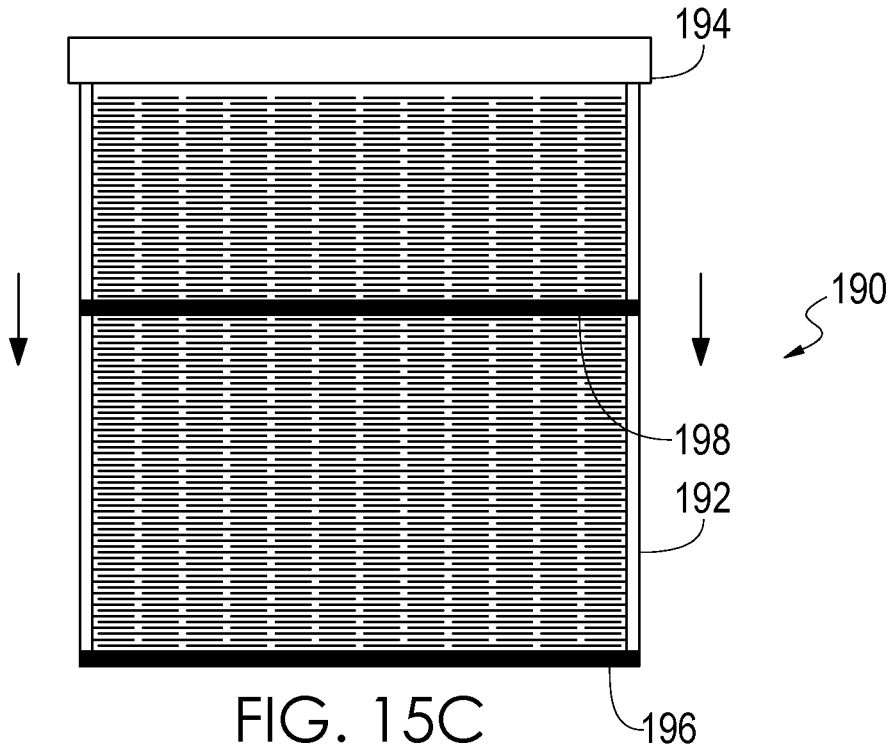
Figure 15D:
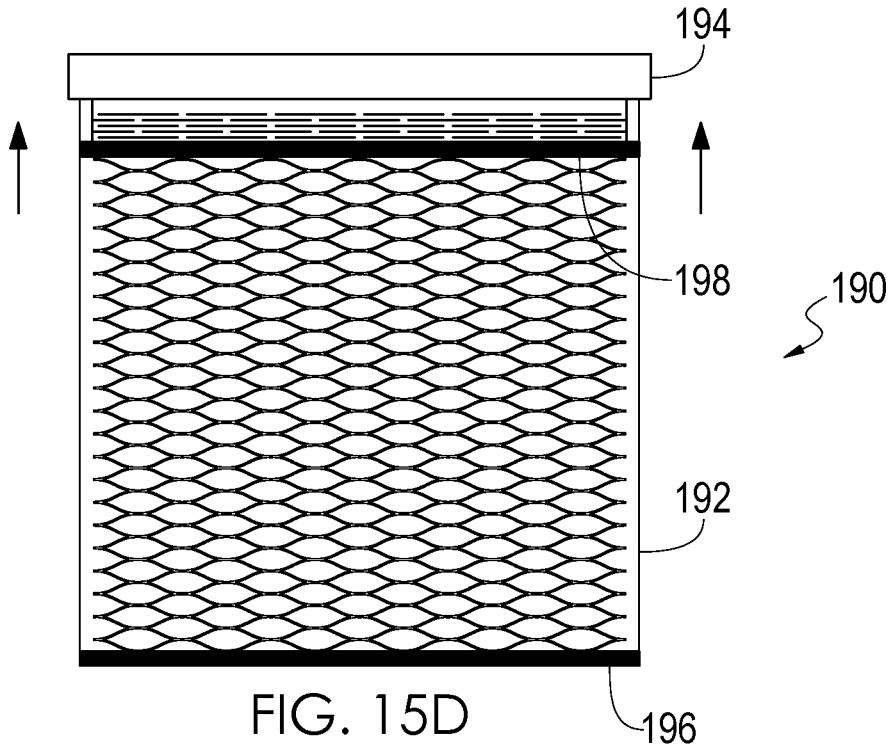

To adjust the screen 190 to let in more light, a second track member 198 can be driven downward along the opposed tracks, as depicted in FIG. 15C, over the screen to a point along the length of the screen that is within the window space. The location of that point depends upon the ultimate orientation of the screen 190 that is desired (e.g., the degree to which the screen is to be opened). Once the appropriate point has been reached by the second track member 198, the second track member can grip the screen 190 and then travel in the upward direction, as depicted in FIG. 15D, to apply a tensile force to the screen that stretches the screen to open it up. Simultaneous to the upward travel of the second track member 198, the motor within the housing 194 can roll up the unopened portion of the screen 190 above the second track member 198 into the housing. Because that portion of the screen is unopened, it is generally flat and can be more easily rolled up. Upward motion of the second track member 198 and operation of the housing motor can be halted once the desired screen orientation has been achieved, for instance when the second track member is adjacent the housing 194 as shown in FIG. 15D.

Figure 16:
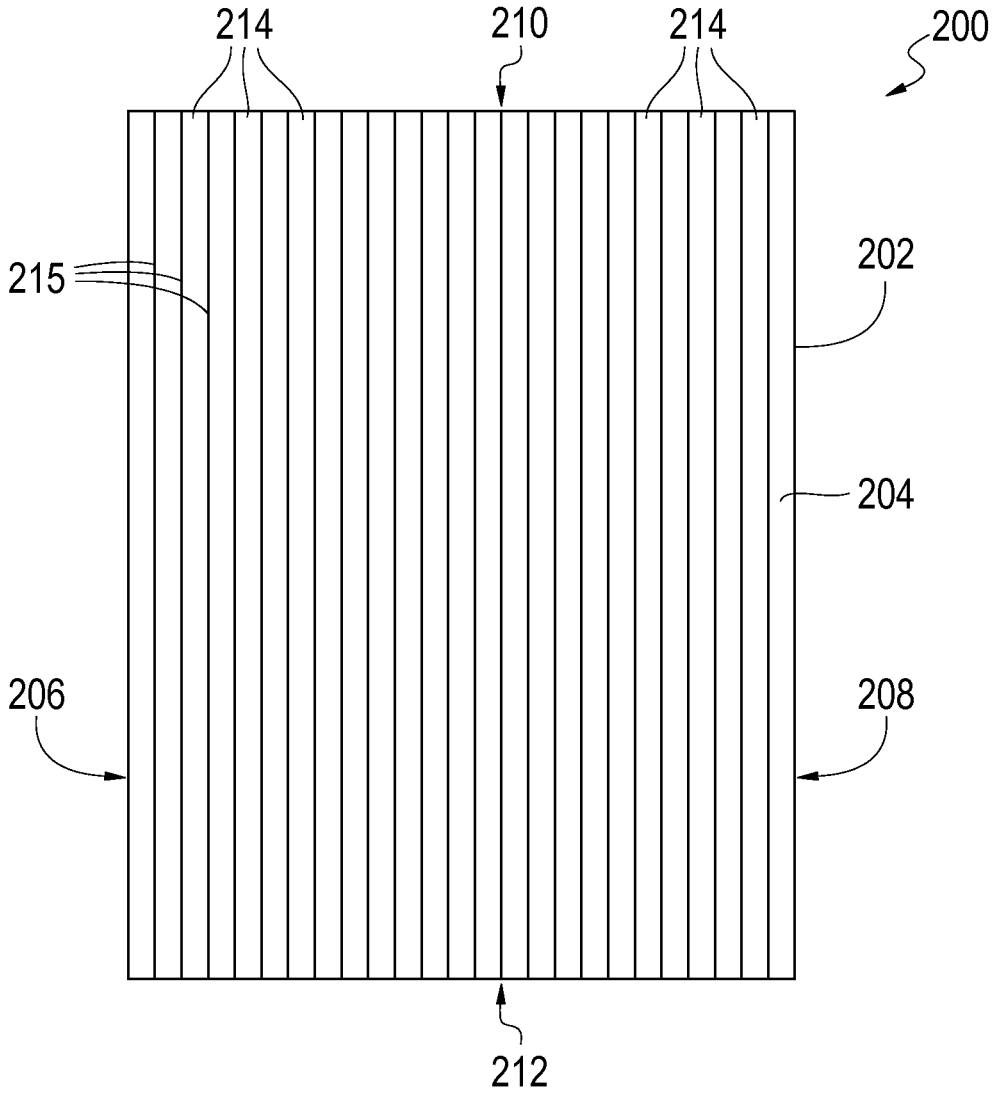
FIG. 16 is a front view of a seventh embodiment of a variable screen shown in a closed orientation.
Figure 17:
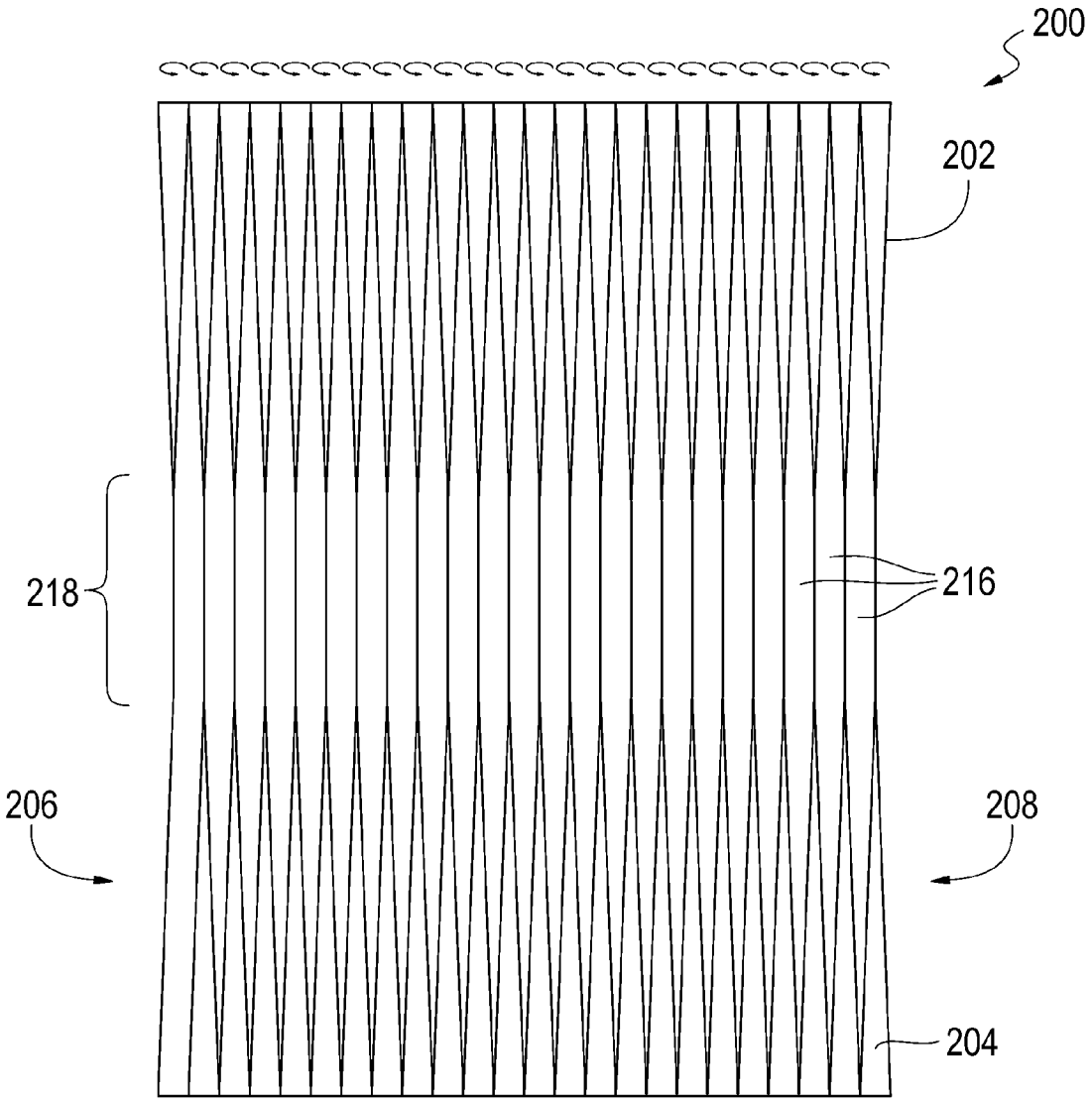
FIG. 17 is a front view of the variable screen of FIG. 16 shown in a first open orientation.
Figure 18:
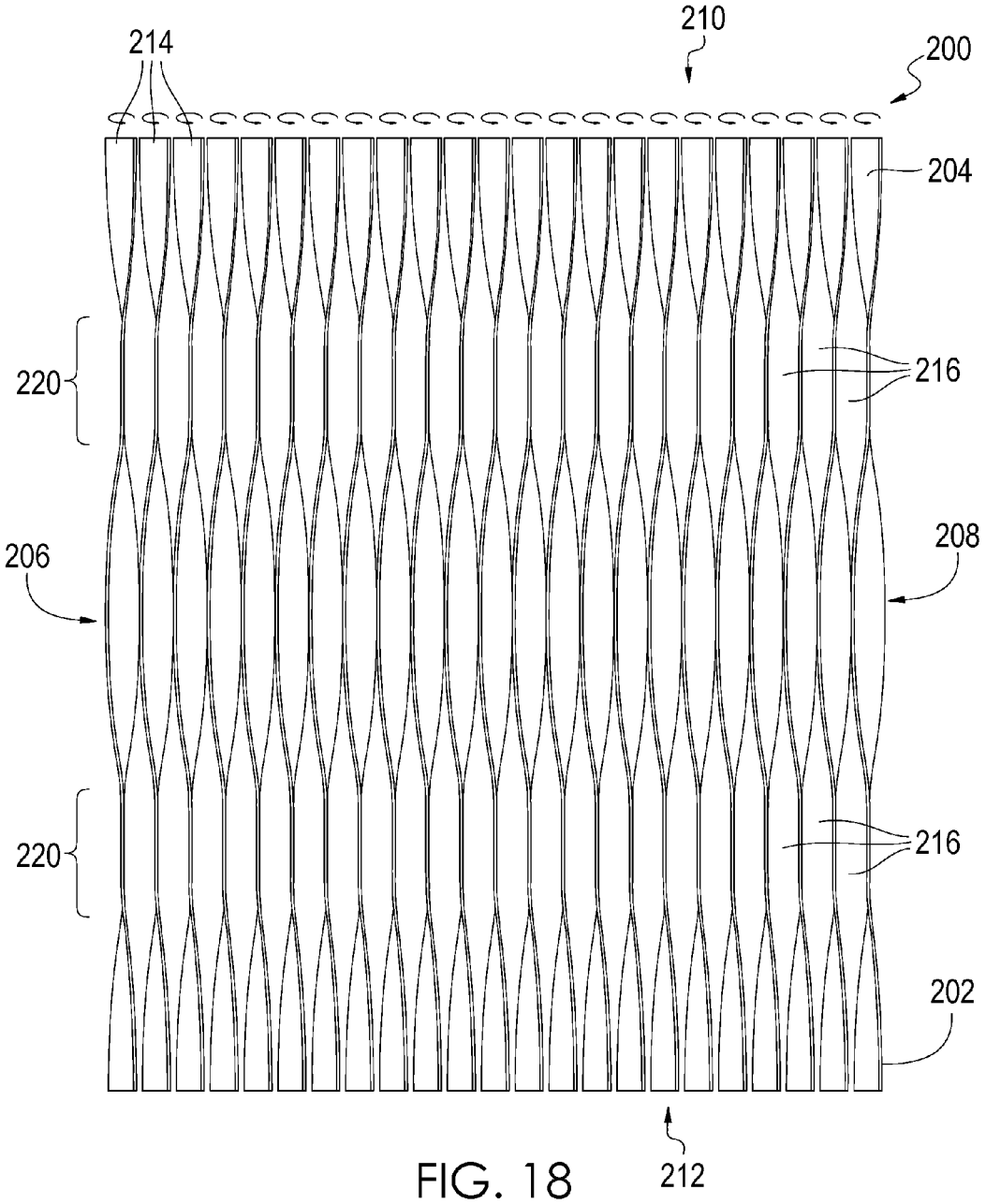
FIG. 18 is a front view of the variable screen of FIG. 16 shown in a second open orientation.

FIGS. 16-18 illustrate a seventh embodiment of a variable screen 200. As with the embodiments of FIGS. 1-11, the screen 200 comprises a generally flat sheet 202 of material that is defined at least in part by a first or front surface 204, a second or back surface (not visible), opposed lateral edges 206 and 208, a first or top edge 210, and a second or bottom edge 212. Also like the previously-described embodiments, the material used to construct the flat sheet 202 is a shape memory material that can be deformed in or more directions in response to an applied force, and return to its original shape when the force is removed.

Unlike the previously described embodiments, however, the sheet 202 is formed from multiple independent strips 214 of material that are not connected to each other. The strips 214 are positioned edge-to-edge across the width of the sheet 202 and extend generally parallel to each other along a vertical direction of the sheet (in the orientation of FIGS. 16-18) so as to form slits 215. Because each strip 214 is independent of the other strips, each strip can be twisted about its longitudinal (e.g., vertical) axis, as is depicted in FIG. 17, for example using one or more motors (not shown). When the strips 214 are individually twisted, the strips form openings 216 through which light or fluids may pass. By way of example, the openings 216 can be "diamond" shaped. As is shown in FIG. 17, a given amount of twisting can result in a band 218 of openings 216 being formed across the lateral width of the screen 200 (in the orientation of FIG. 17).

In some embodiments, further twisting of the strips 214 can result in the formation of multiple bands 220 of openings 216. The screen 200 is similar to the other screens described in this disclosure given that a force is applied to the screen to open it and the screen automatically returns to its normal, closed orientation when the force is removed due to the use of shape memory materials.

The invention claimed is:

1. A variable screen comprising:

a generally flat sheet having a front surface and a back surface, the sheet comprising a plurality of elongated strips of textile material that are connected to each other at discrete connection points along their lengths so as to define a plurality of elongated slits that extend through the sheet from the front surface to the back surface; and shape memory elements that extend along opposed edges of the strips in a longitudinal direction of the strips;

wherein the slits are adapted to open into passages through which light and fluid can pass when a tensile force is applied to the sheet in a direction generally perpendicular to the slits and automatically close when the tensile force is removed.

2. The variable screen of claim 1, wherein the textile material is a woven fabric.

3. The variable screen of claim 1, wherein the strips are connected to each other at the connection points with textile material that is sewn or glued to the edges of the strips.

4. The variable screen of claim 1, wherein the strips are sewn or glued to each other at the connection points.

5. The variable screen of claim 1, wherein the shape memory elements are rods of shape memory material.

6. The variable screen of claim 1, wherein the shape memory elements are disposed in elongated pockets formed along the edges of the strips.

7. The variable screen of claim 1, wherein the textile material is a ripstop nylon.

8. The variable screen of claim 1, wherein the slits are linear and parallel to each other and perpendicular to opposed edges of the sheet.

9. The variable screen of claim 1, wherein the slits are arranged in rows and columns, and wherein the rows partially overlap each other so that the slits are arranged in a staggered configuration across the sheet.

10. The variable screen of claim 1, wherein the shape memory elements are fiberglass battens.

11. A variable screening system comprising:

a variable screen comprising a generally flat sheet having a front surface, a back surface, the sheet being made of elongated strips of textile material that are connected together at discrete connection points along their lengths and being reinforced with shape memory elements, the strips defining elongated slits that extend through the sheet;

a housing adapted to receive the screen; and a motor adapted to roll up the screen into the housing and to apply a tensile force to the variable screen in a direction generally perpendicular to the slits, the force causing the slits to open into passages through which light and fluid can pass;

wherein the passages of the screen automatically close when the tensile force is removed.

12. The system of claim 11, wherein the slits are arranged in rows and columns, and wherein the columns partially overlap each other so that the slits are arranged in a staggered configuration across the sheet.

13. The system of claim 11, further comprising a light sensor that senses incident sunlight and wherein the motor is automatically operated responsive to light sensed by the light sensor.

* * * * *